US010039944B2

(12) United States Patent
Hurme

(10) Patent No.: US 10,039,944 B2
(45) Date of Patent: Aug. 7, 2018

(54) AIR INDUCTION NOZZLE

(71) Applicant: MARIOFF CORPORATION OY, Vantaa (FI)

(72) Inventor: Antti Tapio Hurme, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 51 days.

(21) Appl. No.: 14/903,832

(22) PCT Filed: Jul. 11, 2013

(86) PCT No.: PCT/FI2013/050748
§ 371 (c)(1),
(2) Date: Jan. 8, 2016

(87) PCT Pub. No.: WO2015/004309
PCT Pub. Date: Jan. 15, 2015

(65) Prior Publication Data

US 2016/0144212 A1 May 26, 2016

(51) Int. Cl.
*A62C 2/00* (2006.01)
*A62C 31/02* (2006.01)
(Continued)

(52) U.S. Cl.
CPC ..... *A62C 31/02* (2013.01); *A62C 5/008* (2013.01); *A62C 99/0072* (2013.01); *B05B 1/00* (2013.01); *B05B 7/04* (2013.01); *B05B 7/0458* (2013.01)

(58) Field of Classification Search
CPC ..... A62C 31/02; A62C 5/008; A62C 99/0072; B05B 1/00; B05B 7/04; B05B 7/0458; Y10S 239/07
(Continued)

(56) References Cited

U.S. PATENT DOCUMENTS 4,004,733 A * 1/1977 Law ..... B05B 5/043 239/DIG. 7
4,037,991 A 7/1977 Taylor
(Continued)

FOREIGN PATENT DOCUMENTS

DE 4128670 A1 3/1993
DE 19921348 A1 11/2000
(Continued)

OTHER PUBLICATIONS

International Search Report for PCT Application No. PCT/FI2013/050748, dated Mar. 27, 2014, 4 pages.
(Continued)

*Primary Examiner* — Steven J Ganey
(74) *Attorney, Agent, or Firm* — Cantor Colburn LLP

(57) ABSTRACT

A nozzle includes a nozzle housing defining a first flow path having a first inlet at a first end of the nozzle housing and a first outlet at a second end of the nozzle housing. The nozzle housing also defines a second flow path having a second inlet at an outer surface of the nozzle housing and a second outlet in a side wall of the nozzle housing defining the first flow path, the second outlet defining a Coanda profile and having an annular shape around the first flow path. The nozzle housing defines a third flow path having a third inlet at the outer side surface of the nozzle housing and a third outlet in the side wall defining the first flow path, the third outlet comprising a plurality of holes arranged in an annular pattern around the first flow path.

19 Claims, 3 Drawing Sheets

(51) Int. Cl.

| | |
|---|---|
| ***B05B 7/04*** | (2006.01) |
| ***B05B 1/00*** | (2006.01) |
| ***A62C 5/00*** | (2006.01) |
| ***A62C 99/00*** | (2010.01) |

(58) Field of Classification Search
USPC ..... 169/46, 37; 239/1, 8, 419.5, 422, 428, 239/428.5, 433, 434, DIG. 7
See application file for complete search history.

(56) References Cited

U.S. PATENT DOCUMENTS

| | | | | |
|---|---|---|---|---|
| 4,484,710 | A * | 11/1984 | Roznieck ..... | A62C 31/00 239/428.5 |
| 4,634,050 | A | 1/1987 | Shippee | |
| 4,653,693 | A * | 3/1987 | Steingass ..... | A62C 31/02 239/DIG. 7 |
| 5,188,868 | A | 2/1993 | Horii | |
| 5,402,938 | A | 4/1995 | Sweeney | |
| 5,795,517 | A | 8/1998 | Heisler et al. | |
| 2002/0030122 | A1 | 3/2002 | Barnes et al. | |
| 2005/0115722 | A1 | 6/2005 | Lund et al. | |
| 2007/0210186 | A1 | 9/2007 | Fenton et al. | |
| 2010/0230119 | A1 | 9/2010 | Worthy | |

FOREIGN PATENT DOCUMENTS

| | | | |
|---|---|---|---|
| EP | 0444767 | A2 | 9/1991 |
| GB | 1376133 | A | 12/1974 |
| GB | 2431124 | A | 4/2007 |
| JP | 56434458 | A | 2/1989 |
| JP | 3164931 | B2 | 5/2001 |
| RO | 87135 | A2 | 6/1985 |
| WO | 2013029201 | A1 | 3/2013 |

OTHER PUBLICATIONS

Written Opinion for PCT Application No. PCT/FI2013/050748, dated Mar. 27, 2014, 6 pages.

* cited by examiner

AIR INDUCTION NOZZLE

BACKGROUND OF THE INVENTION

The subject matter disclosed herein relates to nozzles and, in particular, to an air-induction nozzle that generates a water mist.

Fire suppression systems provide a fire suppression medium with momentum to counter the buoyancy of the flames so that the fire suppression material can reach a fire plume. When a water mist is utilized as a fire suppression system, the momentum of the water mist is a key performance metric of the system, and it is difficult to produce the momentum necessary to counter the buoyancy of a flame. While a high-pressure water mist system may be used, these systems include components with special requirements to pressurize and distribute the water that may not be feasible for all applications.

BRIEF DESCRIPTION OF THE INVENTION

According to one aspect of the invention, a nozzle includes a nozzle housing defining a first flow path having a first inlet at a first end of the nozzle housing and a first outlet at a second end of the nozzle housing. The nozzle housing also defines a second flow path having a second inlet at an outer surface of the nozzle housing and a second outlet in a side wall of the nozzle housing defining the first flow path, the second outlet defining a Coanda profile and having an annular shape around the first flow path. The nozzle housing defines a third flow path having a third inlet at the outer side surface of the nozzle housing and a third outlet in the side wall defining the first flow path, the third outlet comprising a plurality of holes arranged in an annular pattern around the first flow path.

According to another aspect of the invention, a liquid-mist fire suppression system includes a sensor configured to detect a fire, a nozzle, a liquid supply configured to provide a liquid to the liquid flow path based on a fire detection signal from the sensor, and a pressurized air supply configured to supply pressurized air to the pressurized air flow path based on the fire detection signal from the sensor. The nozzle includes a main air flow path having a first inlet and a first outlet. The nozzle includes a pressurized air flow path having a second outlet into the main air flow path, the second outlet configured to generate a Coanda effect to draw the air into the first inlet of the main air flow path. The nozzle further includes a liquid flow path having a third outlet into the main flow path, the third outlet configured to insert a liquid into the main air flow path to generate a liquid mist out from the first outlet of the main air flow path.

According to another aspect of the invention, a method of generating a liquid mist includes providing air to a first inlet of a nozzle, the nozzle including a main flow path including the first inlet and a first outlet, a second flow path including a second outlet into the main flow path and a third flow path including a third outlet into the main flow path. The method includes providing pressurized air to the second flow path to generate a Coanda effect in the first flow path to draw the air into the first inlet of the first flow path and providing a liquid to the third flow path to form a mist of the liquid out from the first outlet of the main flow path.

According to another aspect of the invention, a method of extinguishing a flame includes detecting a flame and providing air to a first inlet of a nozzle. The nozzle includes a main flow path including the first inlet and a first outlet, a second flow path including a second outlet into the main flow path and a third flow path including a third outlet into the main flow path. The method includes providing pressurized air to the second flow path, based on detecting the flame, to generate a Coanda effect in the first flow path to draw the air into the first inlet of the first flow path. The method also includes providing a flame-extinguishing liquid to the third flow path, based on detecting the flame, to form a mist of the flame-extinguishing liquid out from the first outlet of the main flow path onto the flame.

According to another aspect of the invention, a method of generating a liquid mist includes providing air to a first inlet of a nozzle, the nozzle including a main flow path including the first inlet and a first outlet, a second flow path including a second outlet into the main flow path and a third flow path including a third outlet into the main flow path. The method further includes providing pressurized air to the second flow path to generate a Coanda effect in the first flow path to draw the air into the first inlet of the first flow path. The method also includes providing a liquid to the third flow path to form a mist of the liquid out from the first outlet of the main flow path.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Conventional low-pressure water mist fire-suppression nozzles have difficulty generating sufficient momentum in a water mist while keeping the water droplets small. Embodiments of the invention relate to a water-mist-producing nozzle that uses air induction to provide high momentum to water droplets.

Figure 1:
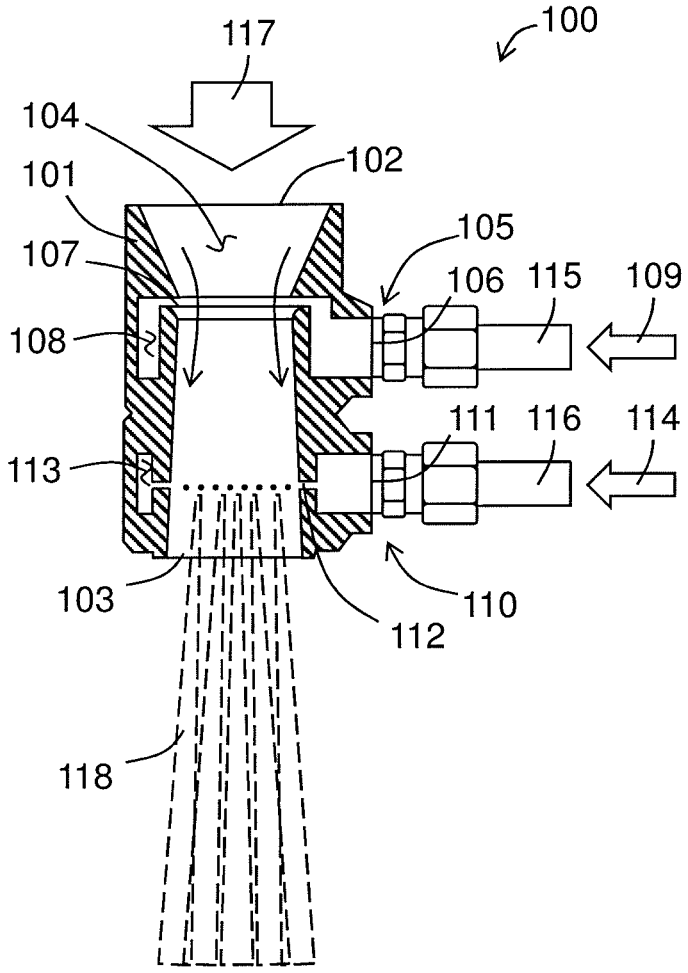
FIG. 1 illustrates an air induction nozzle according to an embodiment of the invention.

FIG. 1 illustrates a nozzle 100 according to an embodiment of the invention. The nozzle 100 includes a nozzle housing 101 defining a main flow path 104. The main flow path 104 has an inlet 102 and an outlet 103. The nozzle housing 101 also defines a second flow path 105 for supplying pressurized air 109 to the main flow path 104 via the outlet 107, and a third flow path 110 for supplying a liquid 114 to the main flow path 104 via the outlet 112. The second flow path 105 includes an inlet 106 for receiving the pressurized air 109 from the tube 115 and an annular cavity 108 between the inlet 106 and the outlet 107. The third flow path 110 includes an inlet 111 for receiving the liquid 114 from the tube 116 and an annular cavity 113 between the inlet 111 and the outlet 112. Although an annular cavity 108 is described above, it is understood that the cavity 108 may have any shape, including annular, irregular, C-shaped, oval-shaped, polygonal shaped or having any other shape.

In one embodiment, the outlet 107 is an annular opening that is open around the entire main flow path 104. In an alternative embodiment, the outlet 107 includes one or more openings surrounding the entire main flow path 104. In embodiments of the invention, the outlet 107 has a Coanda profile configured to generate a Coanda effect in the main flow path 104. In particular, air 109, or another gas, is injected into the main flow path 104 via the outlet 107. The air 109 or gas may be pressurized air or gas 109. The air 109 follows the shaped surface of the outlet 107 defining the Coanda profile, which is shaped to direct the air towards the outlet 103 of the main flow path 104. As the pressurized air 109 flows over the Coanda profile of the outlet 107, the velocity of the air increases, which results in a decreased pressure between the inlet 102 and the outlet 107, inducing air into main flow path 104. As a result, a small volume of pressurized air 109 entering the main flow path 104 generates an air flow of a larger volume of air 117 through the main flow path 104.

While embodiments have been described above with respect to pressurized air 109 and surrounding air 117, it is understood that embodiments of the invention may be implemented with any gas, and particularly with an inflammable gas. In addition, in one embodiment the inside wall of the nozzle housing 101 defining the main flow path 104 narrows from the inlet 102 to the pressurized air outlet 107 and widens from the pressurized air outlet 107 to the main flow path outlet 103. While FIG. 1 illustrates the liquid outlet 112 as being one ring of holes, embodiments of the invention encompass any number of rings of holes arranged circumferentially around the main flow path 104. In an embodiment in which the main flow path 104 has a substantially-circular cross-sectional shape, the ring of holes defining the liquid outlet 112 forms a substantially annular shape around the main flow path 104.

In one embodiment, the outlet 112 is made up of a series of holes arranged in circumferentially around the main flow path 104 to inject the liquid 114 into the main flow path 104 as particles. In particular, as the liquid 114 exits the holes that make up the outlet 112 and interacts the flow of air 117 and 109 through the main flow path 104, the liquid 114 forms an atomized mist 118. The atomized mist 118 is made up of small liquid particles due to being output from the holes of the output 112, and is ejected from the outlet 103 at a high velocity based on the velocity generated by the pressurized air 109, which forms a Coanda effect in the main flow path 104, drawing air into the main flow path 104. In an alternative embodiment, the outlet 112 may be made up of a series of slits, a single slit, a combination of holes, slits or other openings, or any other shapes capable of injecting the liquid 114 into the main flow path 108 to form the atomized mist 118.

Figure 2:
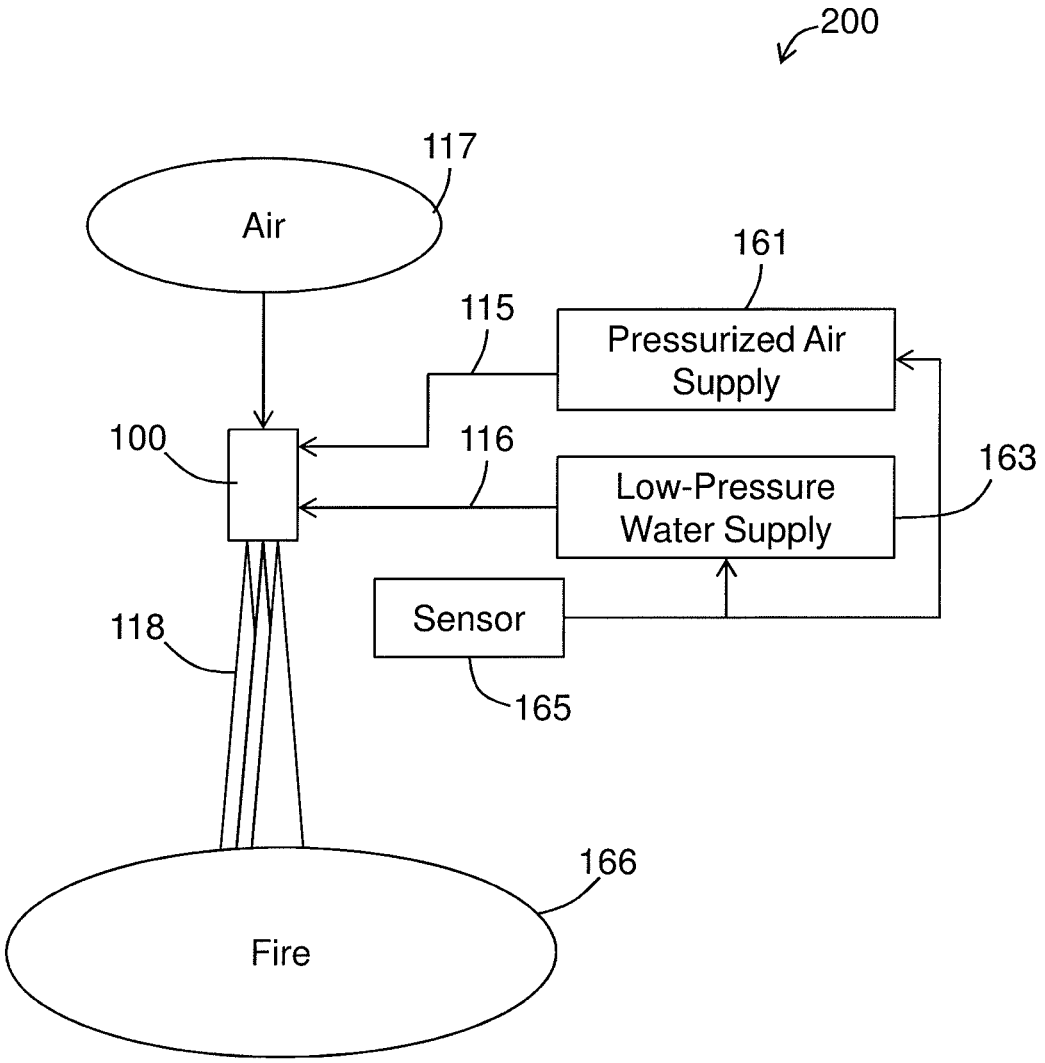
FIG. 2 illustrates a fire suppression system according to an embodiment of the invention.
Figure 3:
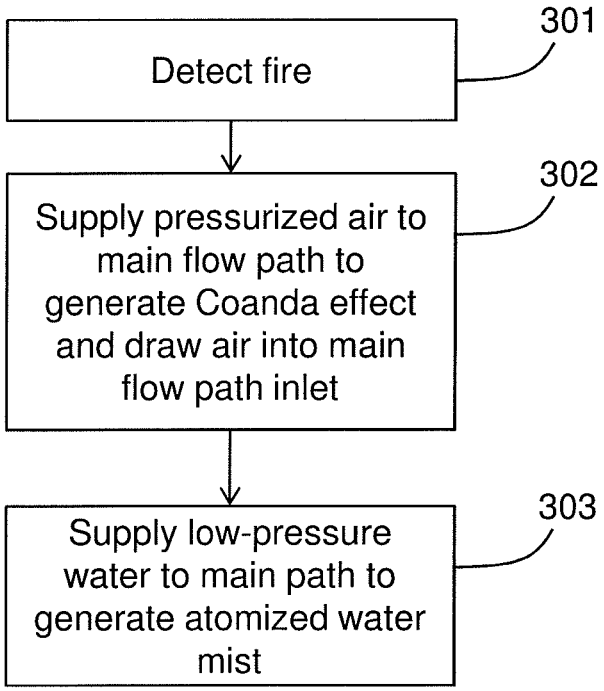
FIG. 3 illustrates a flowchart of a method for extinguishing a fire according to an embodiment of the invention.

FIG. 2 illustrates a fire suppression system 200 according to an embodiment of the invention. The system includes the nozzle 100, a pressurized air supply 161, a water supply 163 and a sensor 165. In one embodiment, the water supply 163 is a low-pressure water supply. FIG. 3 illustrates a method of extinguishing a fire according to an embodiment of the invention.

Referring to FIGS. 2 and 3, a fire 166 is detected by the sensor 165 in block 301. The sensor 165 generates a fire-detection signal to activate the pressurized air supply 161 in block 302 and the low-pressure water supply 163 in block 303. The pressurized air supply 161 supplies pressurized air 109 to the nozzle 100 via the tube 115, and the low-pressure water supply 163 supplies the low-pressure water 114 to the nozzle 100 via the tube 116. The pressurized air 109 flows over a Coanda profile in the nozzle 100 which draws air 117 into the nozzle at a high velocity. The low-pressure water 114 enters the main flow path of the nozzle 100 via a series of holes around the main flow path, and the water droplets are driven by the air 117 flowing through the nozzle 100 to form an atomized mist 118 of water droplets having a small size and high velocity. The size and velocity of the water droplets may vary from one nozzle to another and from one fire suppression system to another. The mist 118 is directed to the fire 166 to extinguish the fire 166. A particular size and velocity of the water droplets may be achieved according to design considerations of the particular nozzle or fire suppression system. Characteristics of the nozzle that may be adjusted to adjust size and velocity of water droplets may include opening sizes of inlets to a main flow path and of the main flow path to an atmosphere, shapes and contours of flow paths, or any other features of the nozzle.

While the sensor 165 is illustrated in FIG. 2 as generating a fire-detection signal to activate the pressurized air supply 161 and the low-pressure water supply 163, embodiments of the invention encompass a system 200 including a controller that receives the fire-detection signal and activates the pressurized air supply 161 and the low-pressure water supply 163. In addition, while only one nozzle 100 and one sensor 165 are illustrated in FIG. 2, embodiments of the invention encompass any number of sensors that trigger any number of nozzles.

According to embodiments of the invention, low-pressure air is induced into a nozzle based on a Coanda effect generated by a pressurized stream of air flowing over the Coanda profile. The resulting flow of air through the nozzle travels at a high velocity. A low-pressure supply of water is provided to the nozzle and injected into the high-velocity stream of air in the nozzle to generate a high-velocity atomized water mist that may be applied to a fire to suppress or extinguish the fire. Technical benefits of embodiments of the invention include using a supply of relatively low-pressure air surrounding a nozzle and low-pressure water to generate a high-velocity atomized mist of water by inducing the flow of low-pressure air surrounding the nozzle through a nozzle by guiding pressurized air over a Coanda profile, thus generating a vacuum in the nozzle to draw in the surrounding air.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A nozzle, comprising:

a nozzle housing defining a first flow path having a first inlet at a first end of the nozzle housing and a first outlet at a second end of the nozzle housing, a second flow path having a second inlet at an outer surface of the nozzle housing and a second outlet in a side wall of the nozzle housing defining the first flow path, the second outlet having a Coanda profile and having an annular shape around the first flow path, and a third flow path having a third inlet at the outer side surface of the nozzle housing and a third outlet in the side wall defining the first flow path, the third outlet comprising a plurality of holes arranged circumferentially around the first flow path.

2. The nozzle of claim 1, wherein the first inlet is configured to receive a gas flow to direct the gas flow along the first flow path, the second flow path is configured to direct a pressurized gas flow into the first flow path via the second outlet, and the third flow path is configured to direct a low-pressure liquid into the first flow path via the third outlet.

3. The nozzle of claim 2, wherein the gas and the pressurized gas are air, and the low-pressure liquid is water.

4. The nozzle of claim 2, wherein the second outlet is configured to generate a Coanda effect in the first flow path with the pressurized gas flow from the second flow path to draw the gas into the first inlet.

5. The nozzle of claim 1, wherein the first flow path narrows from the first inlet to the second outlet and widens from the second outlet to the first outlet.

6. The nozzle of claim 1, wherein the second outlet is a continuous annular opening in the side wall of the nozzle housing defining the first flow path.

7. The nozzle of claim 1, wherein the second outlet is located between the first outlet and the third outlet.

8. A liquid-mist fire suppression system, comprising:

a sensor configured to detect a fire;

a nozzle including a main air flow path having a first inlet and a first outlet, a pressurized air flow path having a second outlet into the main air flow path, the second outlet configured to generate a Coanda effect to draw the air into the first inlet of the main air flow path, and a liquid flow path having a third outlet into the main flow path, the third outlet configured to insert a liquid into the main air flow path to generate a liquid mist out from the first outlet of the main air flow path;

a liquid supply configured to provide the liquid to the liquid flow path based on a fire detection signal from the sensor; and a pressurized air supply configured to supply pressurized air to the pressurized air flow path based on the fire detection signal from the sensor.

9. The liquid-mist fire suppression system of claim 8, wherein the liquid is water.

10. The liquid-mist fire suppression system of claim 8, wherein the liquid supply is configured to supply the liquid to the nozzle at a low pressure.

11. The liquid-mist fire suppression system of claim 8, wherein the first flow path narrows from the first inlet to the second outlet and widens from the second outlet to the first outlet.

12. The liquid-mist fire suppression system of claim 8, wherein the second outlet is a continuous annular opening in a side wall of the first flow path.

13. The liquid-mist fire suppression system of claim 8, wherein the second outlet is located between the first outlet and the third outlet.

14. A method of generating a liquid mist, comprising:

providing air to a first inlet of a nozzle, the nozzle including a main flow path including the first inlet and a first outlet, a second flow path including a second outlet into the main flow path and a third flow path including a third outlet into the main flow path;

providing pressurized air to the second flow path to generate a Coanda effect in the first flow path to draw the air into the first inlet of the first flow path; and providing a liquid to the third flow path to form a mist of the liquid out from the first outlet of the main flow path;

wherein the third outlet is a plurality of holes arranged annularly around the first flow path to form the mist out from the first outlet.

15. The method of claim 14, wherein the liquid is water, and the mist is a water mist.

16. The method of claim 14, wherein the liquid is provided at a low pressure.

17. A method of extinguishing a flame, comprising:

detecting a flame;

providing air to a first inlet of a nozzle, the nozzle including a main flow path including the first inlet and a first outlet, a second flow path including a second outlet into the main flow path and a third flow path including a third outlet into the main flow path;

providing pressurized air to the second flow path, based on detecting the flame, to generate a Coanda effect in the first flow path to draw the air into the first inlet of the first flow path; and providing a flame-extinguishing liquid to the third flow path, based on detecting the flame, to form a mist of the flame-extinguishing liquid out from the first outlet of the main flow path onto the flame.

18. The method of claim 17, wherein the pressurized air is provided at a high pressure and the flame-extinguishing liquid is provided at a low pressure.

19. The method of claim 17, wherein the third outlet is a plurality of holes arranged annularly around the first flow path to form the mist out from the first outlet.

* * * * *